US005321417A

United States Patent [19]

Voelzke et al.

[11] Patent Number: 5,321,417

[45] Date of Patent: Jun. 14, 1994

[54] VISUAL DISPLAY PANEL

[75] Inventors: Vernon P. Voelzke; Troy A. Erickson, both of Brookings, S. Dak.; Ronald L. Sitzema, Charlevoix, Mich.

[73] Assignee: Daktronics, Inc., Brookings, S. Dak.

[21] Appl. No.: 750,963

[22] Filed: Aug. 28, 1991

[51] Int. Cl.[5] ..... G09G 3/20

[52] U.S. Cl. ..... 345/32; 40/550; 362/240; 340/815.76

[58] Field of Search ..... 340/763, 764, 783, 815.15, 340/815.27, 764; 40/550, 552, 551; 313/111, 113; 357/833, 834

[56] References Cited

U.S. PATENT DOCUMENTS

| | | | |
|---|---|---|---|
| 1,442,463 | 1/1923 | Bowman | 359/613 |
| 3,273,140 | 9/1966 | Foster et al. | 40/452 |
| 3,750,138 | 7/1973 | Burgan et al. | 340/764 |
| 4,118,763 | 10/1978 | Osteen | 359/833 |
| 4,186,394 | 1/1980 | Bobak et al. | 340/764 |
| 4,234,914 | 11/1980 | Boesen | 40/550 |
| 4,254,453 | 3/1981 | Mouyard et al. | 40/550 |
| 4,446,511 | 5/1985 | Sands | 313/113 |
| 4,531,121 | 7/1985 | Brown | 340/815.24 |
| 4,683,491 | 7/1987 | Shimada et al. | 340/752 |
| 4,742,432 | 5/1988 | Thillays et al. | 340/719 |
| 4,833,542 | 5/1989 | Hara et al. | 358/241 |
| 4,843,527 | 6/1989 | Britt | 40/550 |

*Primary Examiner*—Ulysses Weldon
*Assistant Examiner*—Gin Goon
*Attorney, Agent, or Firm*—Burd, Bartz & Gutenkauf

[57] ABSTRACT

A light transmitting, visual display panel for use as a sign or message board and comprised of a plurality of closely adjacent, rectangular modules, each of which includes a closed, vertically disposed housing having top, bottom, side and back walls, and a front wall comprised of a plurality of closely adjacent, interchangeable, rectangular, 3-dimensional, light refracting filtering lenses. The lenses are removably secured in the housing. A vertical array of individual light sources is disposed within the housing behind the lenses and dividers behind the lenses separate the light sources. Each housing includes at least one pressurizing cooling fan and narrow, slot-like air exhaust ducts are provided between adjacent lenses.

11 Claims, 7 Drawing Sheets

VISUAL DISPLAY PANEL

BACKGROUND OF THE INVENTION

1. Field of the Invention

This invention relates to visual display panels made up of a plurality of closely adjacent, rectangular modules used as signs and similar visual displays in sports arenas and similar sites for the display of pictorial and/or alpha- numerical images. More particularly, the invention relates to lighted visual displays utilizing light refracting prism filters or lenses and incorporating a pressurized air cooling system, for indoor or outdoor use.

2. The Prior Art

Existing methods of constructing colored and monochrome electronic message boards include the use of arrays of closely spaced painted, incandescent bulbs or arrays of colored filters backed by unpainted, incandescent bulbs. Both have disadvantages.

Painted bulbs have a high initial cost and continuing high replacement cost. The filter mechanism, being comprised of a coat of colored paint, requires careful control of pigment particle size and quantity along with coat thickness. Such control is very difficult. The result has been that the color uniformity throughout a display varies both in color saturation and visible light intensity, a problem which is multiplied when bulbs from different manufacturing batches or from different manufacturers are combined in a display. Because incandescent bulbs have a frontal shape which is usually circular, but they are assigned to fill a square area or pixel, the area which the bulbs fill is often less than 60% of the total area assigned to them. This lack of "pixel fill" reduces visual definition, continuity and uniformity of the matrix display.

The present technology of color filters has limited its use to non-optical of fresnel prismatic designs. This limited the display distribution to the individual lamp output, or collomated the light into a narrow field of view.

When such color filters without light refracting prisms are used there is a lack of intensity and color saturation balance between all colors, especially the absence of effective blue light. The amount of illumination toward the spectators or observers, who are usually positioned below the maximum intensity of each individual filter's distribution, is limited. The filters or collomators have no way of controlling illumination above the horizontal plane and waste up to 50 percent of their intensity above the viewing plane. There is no choice of producing a wide angle or concentrated beam display.

Existing filters and matte finishes are selective in the wave length of light they redirect and therefore cause color shift when viewed from different angles. The reflected energy from the bulb is concentrated on the inside rear surface of the filters causing this part to overheat and limit present filter systems to use of low energy bulbs. This restriction, coupled with the lack of blue light in the incandescent spectrum, results in poor intensity-chromaticity balance which, in turn, results in poor daylight viewing and inadequate color balance for best color blending.

SUMMARY OF THE INVENTION

The present invention is directed toward overcoming the disadvantages of the prior art by the use of light refracting prism lenses or filters so as to fill the pixel point as fully as possible with light, reducing the space between lighted areas and increasing the visual resolution. Use of light refracting filters offers the choice of producing either a wide angle or concentrated beam display. The display of the present invention incorporates a pressurized air cooling system permitting the use of higher energy bulbs.

Broadly stated, the present invention is directed to a light transmitting visual display panel comprised of a plurality of closely adjacent rectangular modules, each of which includes a closed, vertically disposed housing having top, bottom, side and back walls, and a front wall comprised of a plurality of closely adjacent, interchangeable, rectangular, 3-dimensional, light refracting, filtering lenses. The lenses are removably secured in the housing. A vertical array of individual light sources is disposed within the housing behind the lenses and dividers behind the lenses separate the light sources. Each housing includes at least one pressurizing cooling fan and narrow, slot-like, air exhaust ducts are provided between adjacent lenses.

The invention also includes the light refracting lenses which include a transparent, pigmented or dyed, rigid, synthetic resinous plastic body having an open back, a flat front wall member having a plurality of narrow, adjacent, horizontal prisms on the outside surface adapted to refract light to an angle below horizontal and a plurality of narrow adjacent vertical horizontal beam spread controlling prisms on the inside surface, along with side and bottom wall members extending rearwardly from the front lens face.

BRIEF DESCRIPTION OF THE DRAWINGS

The invention is illustrated by the accompanying drawings in which corresponding parts are identified by the same numerals, and in which.

DETAILED DESCRIPTION OF THE PREFERRED EMBODIMENT

Figure 1:
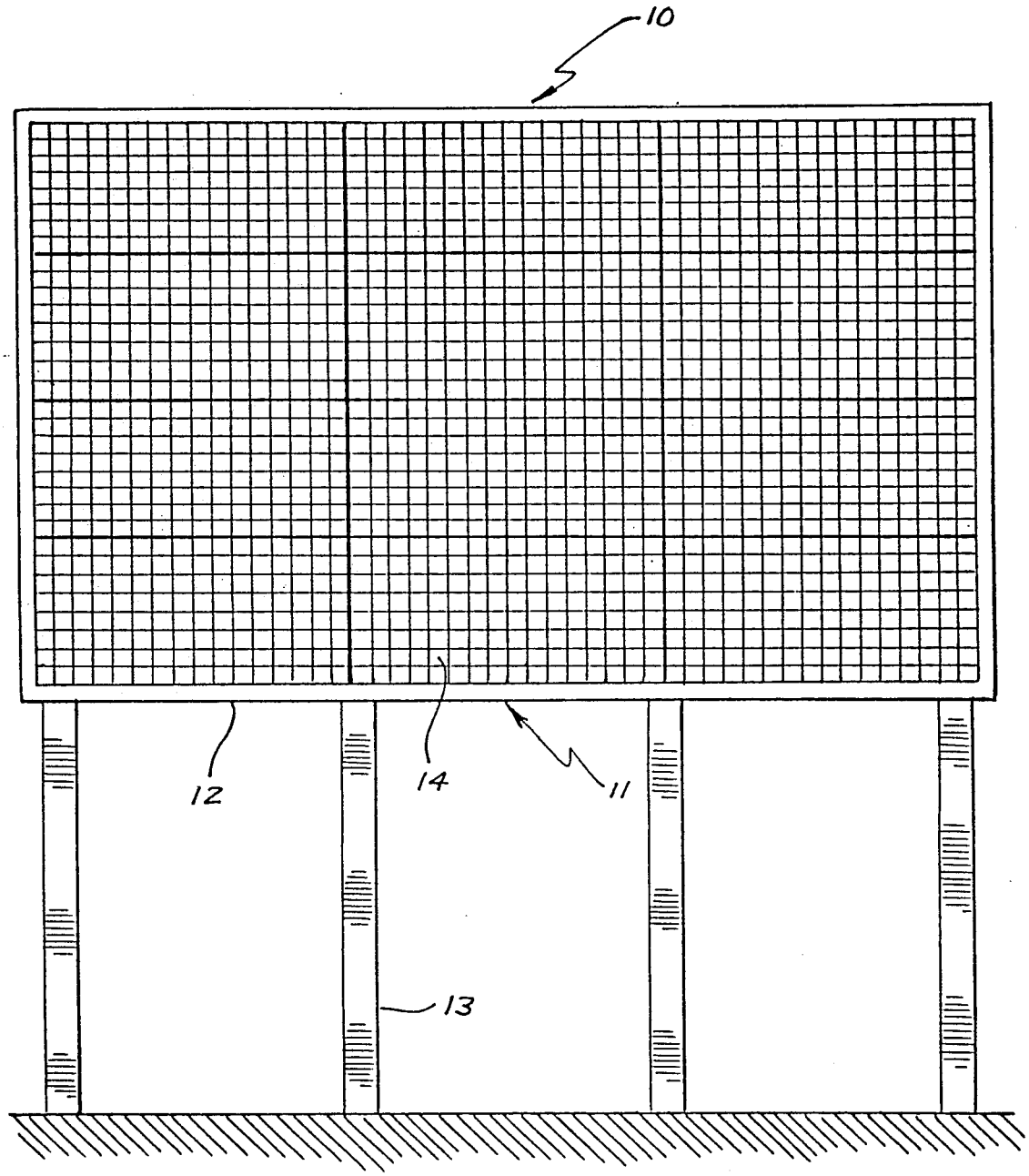
FIG. 1 is a front elevation of a typical visual display panel in the form of a sign or message board comprised of a plurality of closely adjacent modules.

Referring now to the drawings, FIG. 1 shows a typical sign or message board, indicated generally at 10, composed of a plurality of visual display panels or modules, indicated generally at 11, supported within a frame 12 which, in turn, is supported on a plurality of posts or standards 13 above the ground, or the rim of a stadium, or the like. In this instance, the overall sign is composed of twelve display modules 11 each of which, in turn, includes 128 pixels 14, the smaller discrete light elements that together constitute the image portrayed by the overall sign or message board.

Figure 2:
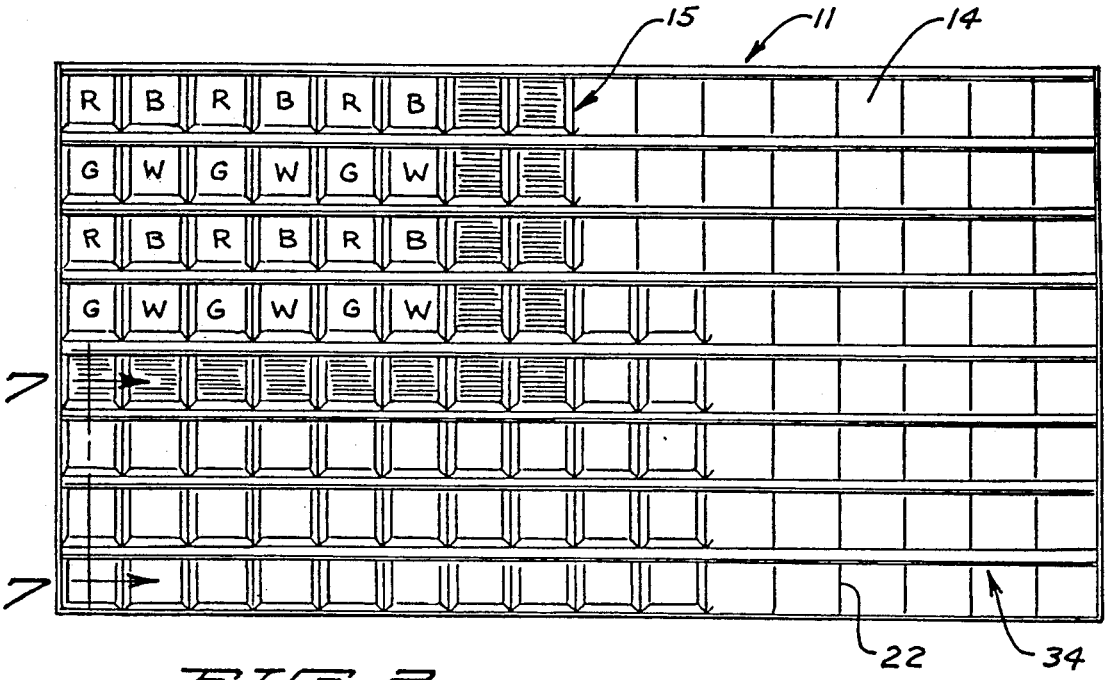
FIG. 2 is a front elevation of an individual display module.
Figure 3:
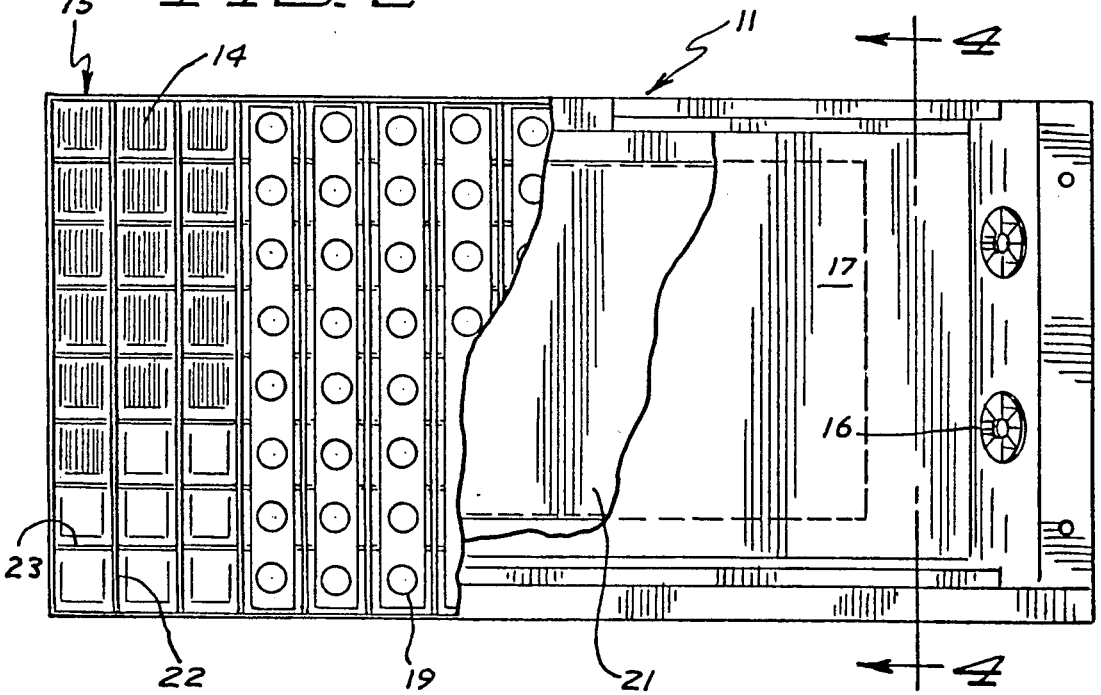
FIG. 3 is a rear elevation of an individual module, partially broken away to reveal several levels of interior structure.
Figure 4:
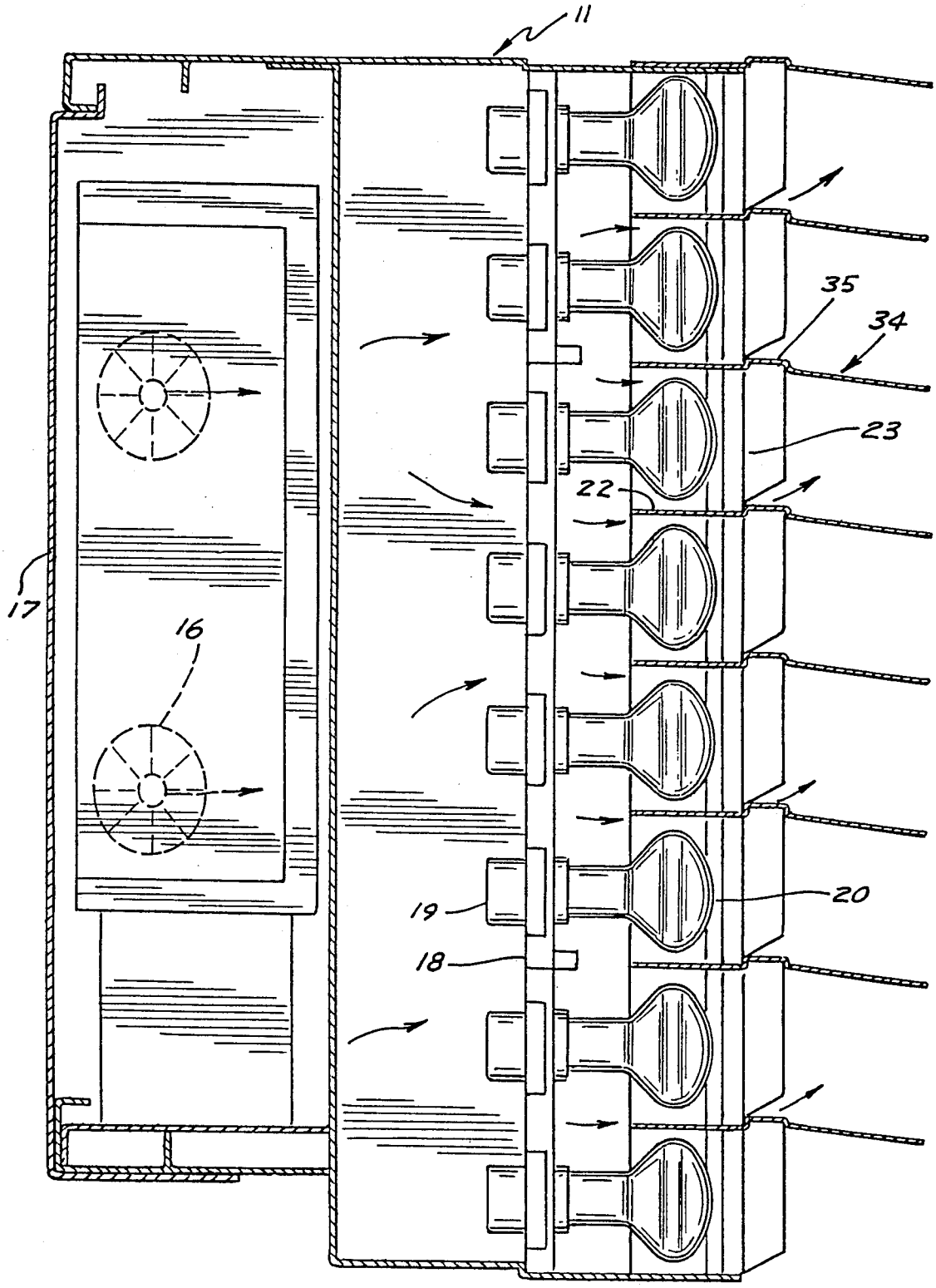
FIG. 4 is a section on an enlarged scale on the line 4—4 of FIG. 3 and in the direction of the arrows.
Figure 5:
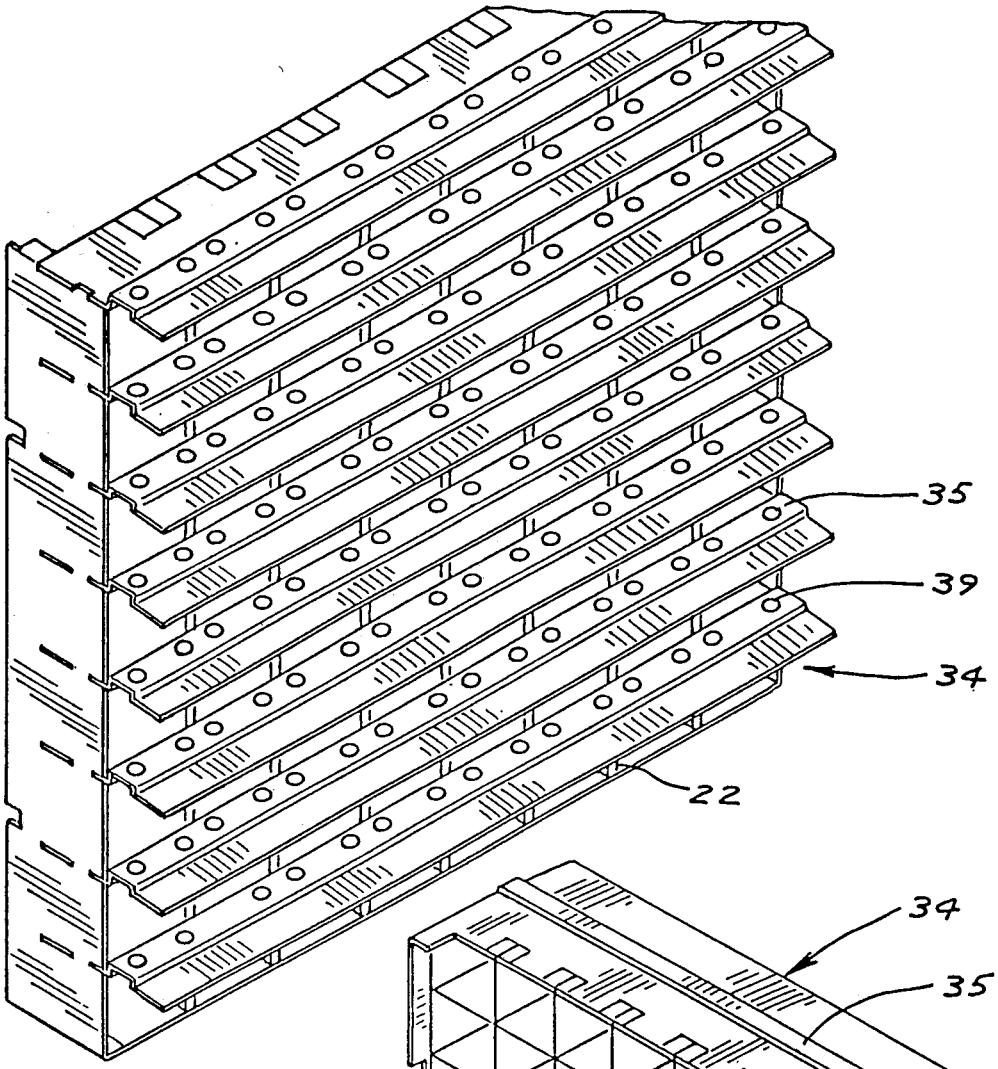
FIG. 5 is a fragmentary perspective view of the front face of an individual module showing louver means for shading the panel and for removably engaging filter lenses, without the lenses in place.

Referring now to FIGS. 2 and 3, there is shown one typical visual display panel module 11 in front and rear elevation, respectively. Each module 11 in this instance is 16 light units or pixels 14 wide by 8 pixels high and, as shown in FIG. 1, the modules are intended to be used in closely adjacent relationship to produce an overall larger image. Each light unit or pixel is fronted by a light refracting lens, indicated generally at 15, as described in greater detail with reference to FIGS. 7 and 8 as to one form of lens, and FIGS. 10 and 11 as to an alternative form of lens. As is common practice in the art, the filtering lenses are usually arranged in groups of four with red (R) in the upper left position, blue (B) in the upper right position, green (G) in the lower left position, and white (W) in the lower right position.

Figure 6:
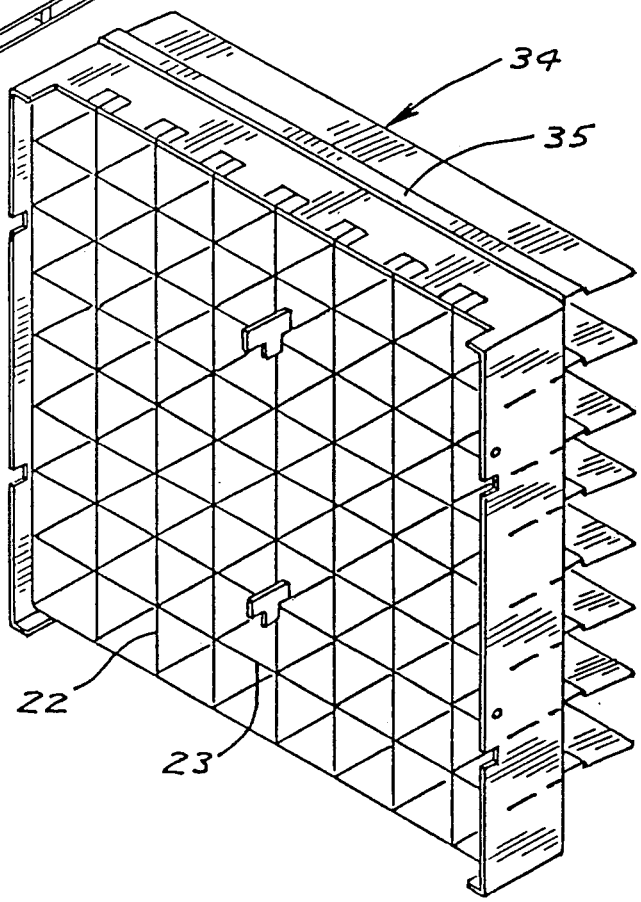
FIG. 6 is a fragmentary perspective rear view showing dividers behind the lenses for separating individual light sources.

Each module 11 comprises a closed rectangular box, having top, bottom, end, back and front walls, the front wall being comprised of the array of lenses 15. One or more pressurizing fans 16 in the module back wall 17 draw cooling air into the housing and maintain positive air pressure within the module housing. In a typical installation four such fans (as Model AC 4715 FS sold by the Boxed Fan Division of NMB Technologies Incorporated) may be used, each of which creates an air flow of from about 60 to 110 cubic feet per minute, and a pressure of about 2.03 to 9.9 mm of water. An intermediate vertical wall 18 supports a plurality of sockets 19, in this instance 128 in number, for receiving light sources in the form of incandescent bulbs 20. As is well understood in the art, bulbs 20 are energized in a preprogrammed sequence through an electronic control system or driver unit 21 disposed in the back of the module housing. As seen by reference to FIG. 6, for example, the individual light cells, each containing a bulb 20, are separated by an "egg crate"-style array of thin vertical dividers 22 and horizontal dividers 23 held together in a rectangular configuration within the module housing. The dividers may be formed, for example, of thin sheet metal, such as aluminum.

Figure 7:
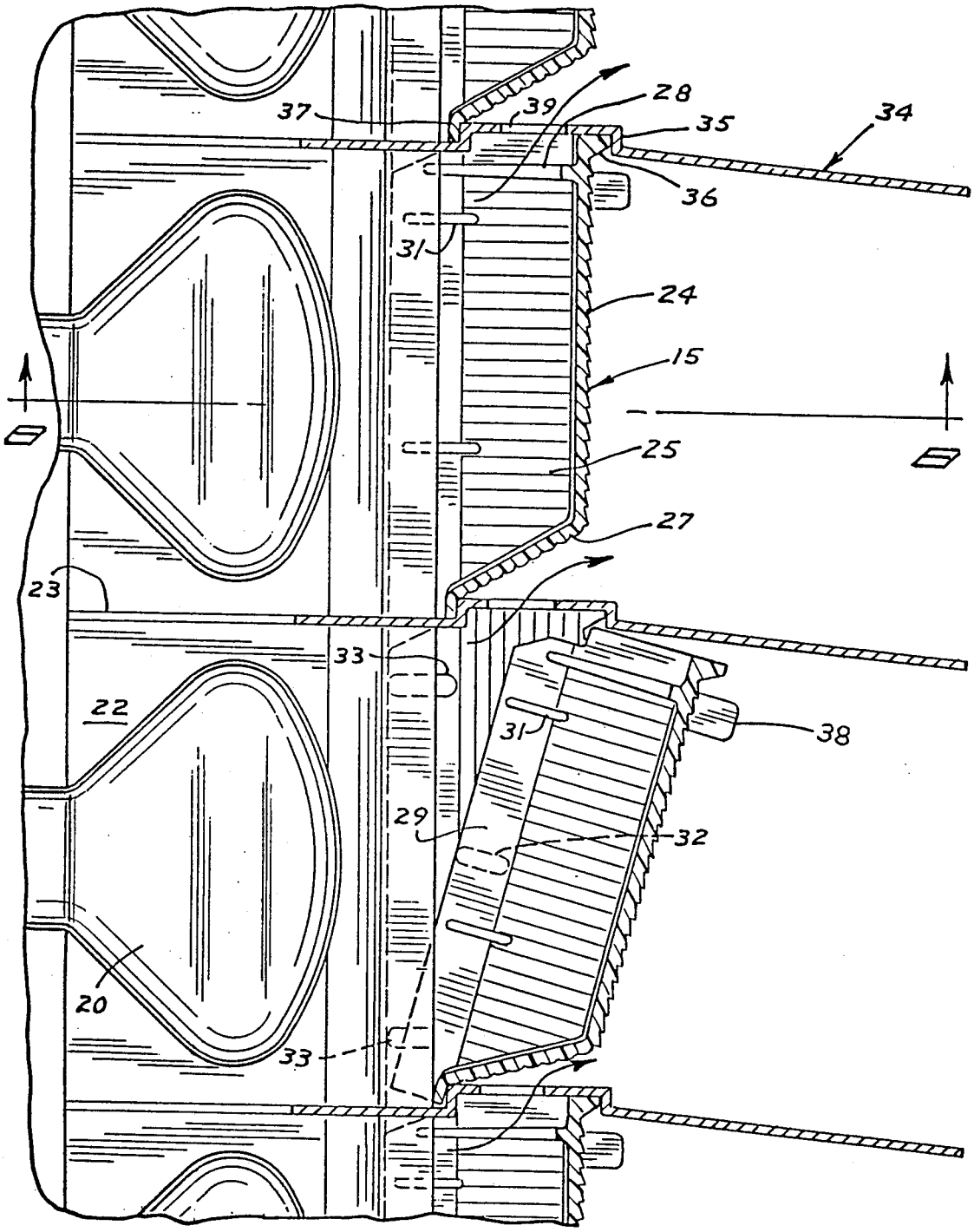
FIG. 7 is a fragmentary vertical section on an enlarged scale on the line 7—7 of FIG. 2 and in the direction of the arrows showing details of module and lens structure.
Figure 8:
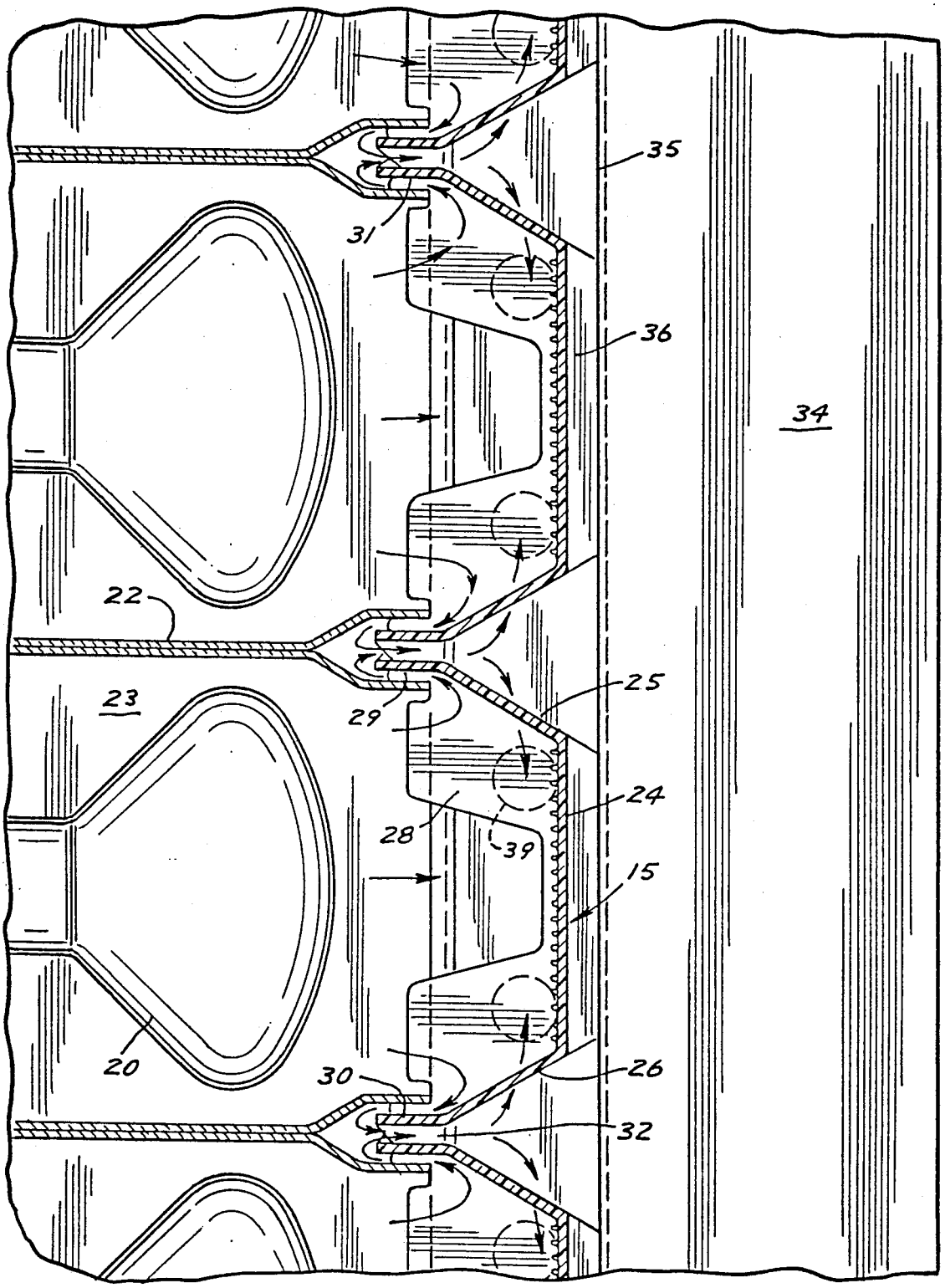
FIG. 8 is a horizontal section on the line 8—8 of FIG. 7 and in the direction of the arrows.

As best seen by reference to FIGS. 7 and 8, each lens 15 includes a flat front wall member 24, flat side wall members 25 and 26 which are inclined angularly outwardly and rearwardly from the front face 24, and a similar flat, angularly downwardly and rearwardly inclined, bottom wall 27. Although the top of the lens body is open, a baffle member 28 extends partially across that opening, extending inwardly from the side walls 25 and 26. The outside surface of the front wall 24 of the lens is provided with a plurality of narrow, adjacent, horizontal prism adapted to refract light to an angle at least 5 degrees below horizontal. This is because most illuminated signs are located such that the viewer ordinarily must look upwardly to view the displayed image. At the same time, about 25 percent more illumination below the horizontal, that previously was wasted, is redirected toward the viewer. The selection of prisms for accomplishing this desired result is well understood in the optics art. This horizontal prismatic lens configuration refracts more illumination toward the observers, thereby increasing the total amount of illumination available toward the spectator or observer. However, if left in this distribution the display would still have a limited lateral viewing distribution in which the image of the display would begin to visually breakup or cutoff. To remedy this the inside surface of the front wall 24 is provided with a plurality of narrow adjacent vertical prisms adapted to spread and horizontally distribute the intensity of the beam, widely or narrowly, as dictated by the environment in which the display panel is situated. The side wall members 25 and 26 and bottom wall member 27 are provided with narrow pillow prisms on both the inside and outside surfaces to provide a uniform pixel fill, that is to provide light beam distribution over substantially the entire area occupied by each filtering lens.

The intensity of the beam is distributed horizontally, up to an included angle of about 60° to 120° degrees to provide greater intensity toward a spectator or observer who is not positioned directly perpendicular to the display. The distribution is such that an observer located 30°–40° degrees lateral of the display receives approximately the same illumination levels as an observer located perpendicular to the sign. This is particularly advantageous in a contained area such as a stadium which will allow more viewers to receive information from the display.

The combination of these vertical and horizontal orientated prisms adds an additional benefit of providing a completely filled pixel approximately 50° percent larger than conventional displays. This larger pixel has visually greater uniformity, without the dark strictions associated with a conventional display, or bright localized intensity peaks from the lamp filament or stray light inside the reflector contour.

Flanges 29 and 30 project rearwardly from lens side walls 25 and 26, respectively. A plurality of vertically spaced apart, horizontal ribs 31 project inwardly from the inside surfaces of flanges 29 and 30. Flanges 31 serve as spacers to provide ducts for air exhaust, as explained hereinafter. The outside surface of flange 29 is provided with a further outwardly projecting, horizontal rib 32, and the outside surface of flange 30 is provided with a pair of vertically spaced apart, horizontal ribs 33. The ribs 32 nd 33 are displaced vertically from one another such that when adjacent lenses are placed in abutting, side-by-side relation, the outside surfaces of the flanges and ribs define slot-like exhaust ducts, as explained hereinafter.

The filtering lenses 15 are readily removable from the module. A series of thin horizontal louvers 34 divide each horizontal row of lenses. Louvers 34 extend forwardly from the front edges of horizontal light dividers 23. Each louver 34 includes a longitudinal projection 35 on its upper surface, spaced inwardly from the forward edge. Projection 35 defines a corresponding channel on the bottom surface of the louver. A forwardly extending lip 36 along the top front edge of the lens body engages that channel, as do the top edges of the lens side walls 25 and 26. A further lip 37 projects downwardly from the bottom edge of the lens body and engages the rearward edge of projection 35 on the next adjacent lower louver. The forward edges of louvers 35 preferably extend downwardly at a slight angle of about 3° to 7° degrees, preferably about 5° degrees, from horizontal to help shield the lenses from extraneous light and project the filtered light toward the viewer. The louvers are formed from thin sheet metal, such as aluminum, and have some resulting resilience permitting the lenses to be readily snapped into and out of place, as best seen in FIG. 7. The lower lip 37 is placed into engagement with the rearward edge of projection 35 of one louver, and using that as a fulcrum, the lens body is pushed back until lip 36 and the top edges of the lens side walls fully engage the channel formed by the underside of projection 35 in the next higher louver. A forwardly projecting, vertical tab 38 centrally disposed adjacent to the top of the front wall 24 functions as a handle to facilitate insertion and removal of the lens.

The colored filter lenses 15 with their surface prisms are molded from dyed or pigmented, transparent, synthetic resinous plastic materials, of which polycarbonates and acrylics are exemplary.

As best seen in FIG. 8, the forward edges of vertical light dividers 22 are bifurcated and spreadable. The flanges 29 and 30 of two side-by-side lens bodies fit into the bifurcated edges of the vertical dividers. Horizontal lips 31 on the insides of the lens flanges engage the inside surfaces of the bifurcated edges to hold them spaced away from the flange surfaces so as to define longitudinal air exhaust ducts for the discharge of air from the pressurized housing. Further exhaust ducts are defined by the outside flange surfaces of abutting lens bodies which are maintained out of contact by the vertically spaced apart, horizontal ribs 32 and 33 on the outside surfaces of the flanges. Ambient cooling air is drawn into and distributed through the housing by fans 16 and circulates around the hot bulbs. As seen in FIG. 7, the heated exhaust air enters the spaces between the inner flange surfaces and dividers 22, makes a 180 degree turn, and then exits through the ducts between adjacent lens bodies.

Holes 39 in louvers 34, which are spaced to overlie baffles 28 of the lens bodies, provide additional air exhaust ducts. Holes 39 also provide a means to wash loose dust off the inside surfaces of the filtering lenses 15. This is achieved by directing water at those holes with the pressurizing fans 16 in operation but with the display otherwise being off. The turbulance caused by the air and water meeting on the inside surfaces of the lenses provides an agitating cleansing action.

Figure 9:
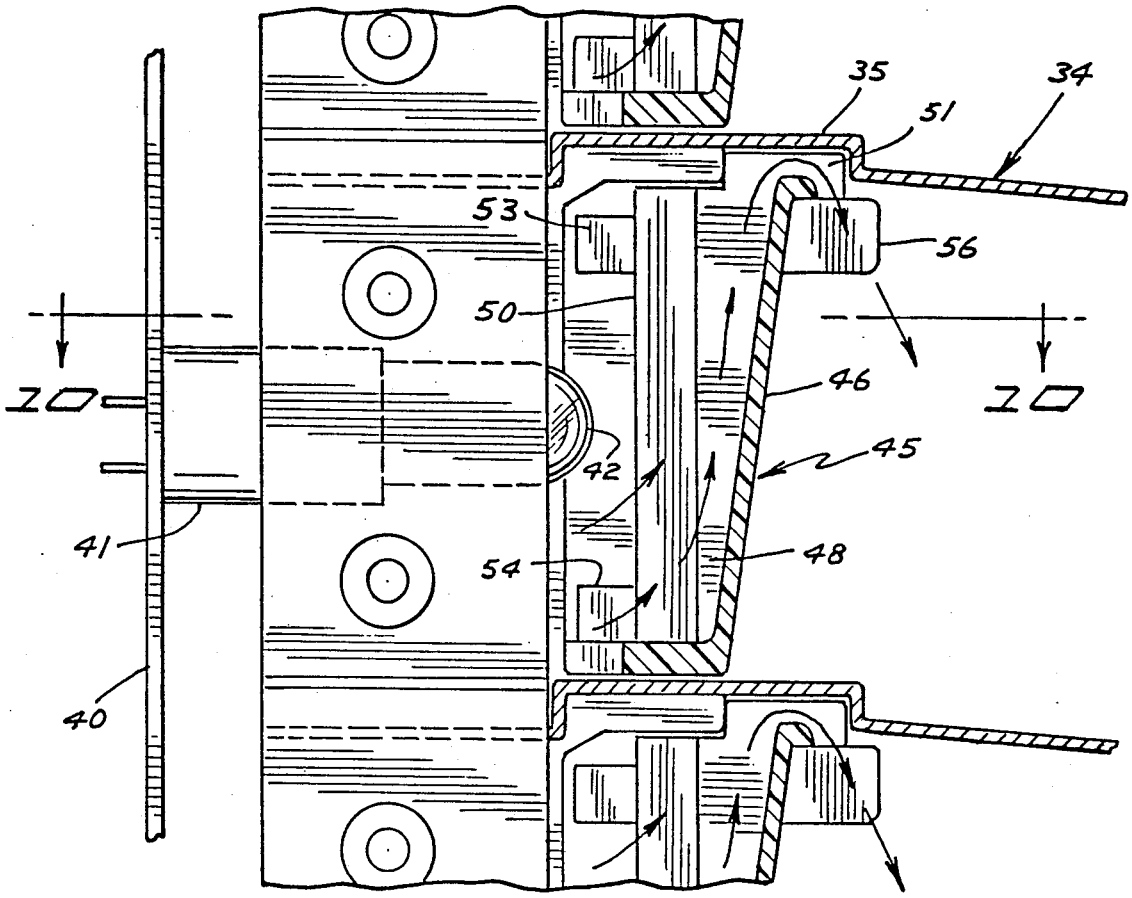
FIG. 9 is a fragmentary vertical section showing an alternative form of lens and light divider.
Figure 10:
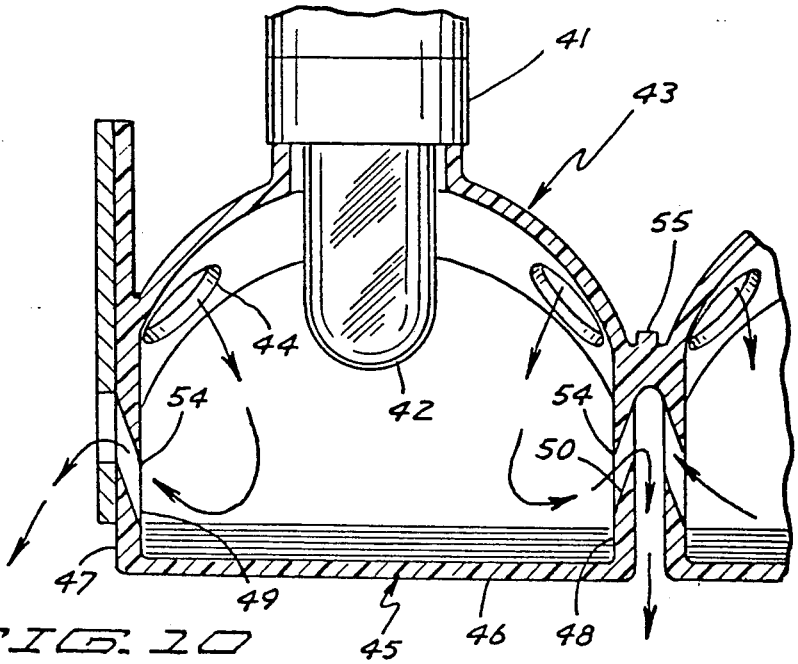
FIG. 10 is a horizontal section on the line 10—10 of FIG. 9 and in the direction of the arrows.

Referring now to FIGS. 9 and 10, there is shown a modified form of the present invention utilizing an alternative form of lens body and light divider system. In all other respects the display panel modules are as previously described. Thus, an intermediate vertical wall 40 supports a plurality of sockets 41 for receiving light sources in the form of bulbs 42. In this instance, the individual light cells, each containing a bulb 42, are separated by a series of parabolic reflectors, indicated generally at 43, preferably molded together as a single unit to include a plurality of dividers in one horizontal row. Each parabolic shell 43 generally surrounds the lightbulb 42. It is provided with holes 44 for passage of pressurized cooling air. The reflectors may be molded, for example, from the polycarbonate resin sold as Lexan, which is readily metalized to provide a reflective surface.

A modified form of filtering lens, indicated generally at 45, includes a flat front wall member 46 occupying substantially all of the pixel area. The outside surface of lens front wall 46 is provided with a plurality of narrow adjacent horizontal prisms adapted to refract light to an angle below horizontal and the inside surface is provided with a plurality of narrow, adjacent, vertical prisms adapted to spread the horizontal beam widely or narrowly as desired. The front lens wall tapers inwardly from the top at an angle between about 6° and 10° degrees, preferably about 8 degrees. Flat, wedge-shaped, side walls 47 and 48 extend rearwardly from the sloping front wall 46. The rear edges of side walls 47 and 48 are tapered and the rearward edges of flanges 49 and 50 extending, respectively, from side walls 47 and 48 are similarly tapered.

Side walls 49 and 50 each project higher than the top edge of lens front face 46 and are provided with forwardly extending ears 51. Ears 51 engage the channel created by the underside of projection 35 of louver 34 to facilitate installation and removal of the lenses, and to provide a horizontal slot exhaust duct for pressurized air from the module housing. A pair of tapered, vertically spaced apart ears 53 and 54 project inwardly from the rearward tapered edges of flanges 49 and 50. Adjacent reflectors 43 are joined at their bottom edges by a bifurcated connector 55 having a V-shaped, forwardly facing slot into which the tapered edges of ears 54 fit. Adjacent lenses are held spaced apart. Pressurized air may exhaust through the spaces between ears 53 and 54 and between adjacent lenses. Handle 56 facilitates insertion and removal of the lens.

The quantity of blue light, relative to other colors in the incandescent spectrum, is low. The pressurized cooling air system according to the present invention permits the use of a higher energy level bulb behind the blue filtering lens, which increases the blue light to a more acceptable quantity. The resulting increased saturation and intensity level enhances the creation of new colors from the mixing of the red, green, blue and white colors. In addition, it brings the intensity of the blue color up to a level where it can be viewed in high outdoor lighting conditions.

It is apparent that many modifications and variations of this invention as hereinbefore set forth may be made without departing from the spirit and scope thereof. The specific embodiments described are given by way of example only. The invention is limited only by the terms of the appended claims.

We claim as our invention:

1. A light transmitting visual display panel comprised of a plurality of closely adjacent rectangular modules, each of said modules comprising:

A) a closed vertically disposed housing having top, bottom, side and back walls, and a front wall comprised of a plurality of closely adjacent interchangeable rectangular three-dimensional filtering lenses, each of said lenses having a top edge and a bottom lip, B) means for removably securing said lenses in said housing, C) a vertical array of individual light sources disposed within the housing behind said lenses, D) dividers behind said lenses separating said light sources, said dividers including horizontal louvers supported at their ends in said housing and extending forwardly from the lenses, said louvers each including on one side a longitudinal channel intermediate between the forward and rearward edges and on the other side a corresponding longitudinal projection, the top edges of said lenses being engageable in said channel of one louver and the bottom lips of said lenses being engageable against the projection of the next adjacent lower louver, E) at least one pressurizing cooling fan in the housing, and F) narrow slot-like air exhaust ducts between adjacent lenses.

2. A visual display panel according to claim 1 wherein each of said filtering lenses comprises:

A) a body having an open back,

B) a flat front wall member having 1) on the outside surface a plurality of narrow adjacent horizontal prisms adapted to refract light to an angle below horizontal, and 2) on the inside surface a plurality of narrow adjacent vertical horizontal beam spread controlling prisms, and C) side and bottom wall members extending rearwardly from said front lens member.

3. A visual display panel according to claim 2 wherein said side and bottom lens wall members are flat and inclined angularly outwardly from the front lens member, and have pillow prisms on the inside and outside surfaces.

4. A visual display panel according to claim 3 wherein:

A) vertical flanges extend rearwardly from the inclined side wall members of said lens, B) vertically spaced apart horizontal ribs project inwardly on the inside surfaces of said flanges, and C) at least one horizontal rib projects outwardly on the outside surface of one of said flanges, and at least a pair of vertically spaced apart horizontal ribs displaced vertically from said other outside horizontal rib project outwardly on the outside surface of the other of said flanges to provide said slot-like exhaust ducts between adjacent lenses.

5. A visual display panel according to claim 4 wherein:

A) vertical and horizontal dividers separate said light sources,

B) the forward edges of said vertical dividers are bifurcated and spreadable, and C) said spreadable divider members engage said inside flange ribs of adjacent lenses to provide an air passage between the divider and flange.

6. A visual display panel according to claim 2 wherein said lens body is composed of pigmented polycarbonate or acrylic synthetic resin.

7. A visual display panel according to claim 2 wherein the flat front wall lens member extends angularly inwardly from top to bottom.

8. A visual display panel according to claim 1 wherein:

A) each of said lenses includes a pair of horizontally spaced apart horizontal baffles forming a partial top wall of said lens, and B) each of said louvers includes at least one hole in the area of the louver overlying said baffles.

9. A visual display panel according to claim 1 wherein said light sources are incandescent bulbs.

10. A visual display panel according to claim 9 wherein:

A) some of said lenses are blue in color, and

B) at least some of the bulbs behind said blue lenses are of higher intensity than the remaining bulbs.

11. A visual display panel according to claim 1 wherein said light dividers include generally parabolic reflectors around said light sources.

* * * * *